US005918294A

United States Patent [19]

Karg

[11] Patent Number: 5,918,294

[45] Date of Patent: Jun. 29, 1999

[54] STACKABLE INTERLOCKING GUITAR

[76] Inventor: Donald J. Karg, 3808 West Rovey Ave., Phoenix, Ariz. 85019

[21] Appl. No.: 08/548,979

[22] Filed: Oct. 27, 1995

[51] Int. Cl.[6] ..... G10D 15/00

[52] U.S. Cl. ..... 84/170; 84/263; 84/267

[58] Field of Search ..... 84/170, 267, 291, 84/293, 263

[56] References Cited

U.S. PATENT DOCUMENTS 4,240,319 12/1980 Soupios ..... 84/263

5,212,329 5/1993 Woodworth ..... 84/263

*Primary Examiner*—William M. Shoop, Jr.

*Assistant Examiner*—Shih-yung Hsieh

*Attorney, Agent, or Firm*—Tod R. Nissle, P.C.

[57] ABSTRACT

A method and apparatus for enabling a player to simultaneously hold and utilize two or more guitars. Two guitars are shaped and dimensioned to be stacked one on to the other and interconnected.

7 Claims, 4 Drawing Sheets

STACKABLE INTERLOCKING GUITAR

This invention relates to guitars.

More particularly, the invention relates to a method and apparatus for enabling a player to simultaneously hold and utilize two or more guitars.

The use of acoustic and electric guitars is well known in the art. During musical concerts, guitar players utilize two or more guitars. In order to switch from a first guitar to a new guitar, a player sets down the first guitar and picks up and plays the new guitar. While concert guitarists are adept at changing out guitars, replacing one guitar with another breaks the continuity of music in the piece being played for an audience. Such a break in continuity is often compensated for by having other instrumentalists play music until the new guitar is in the hands of the performer.

Accordingly, it would be highly desirable to provide apparatus which would permit a performer to instantly begin utilizing a second different guitar without having to dispense with the guitar he is playing.

Therefore, it is a principal object of the invention to provide improved guitar apparatus.

A further object of the invention is to provide improved guitar apparatus which enables a musical performer to instantly switch from playing a first guitar to playing a second guitar without requiring that the performer take off and set down the first guitar.

Another object of the invention is to provide improved guitar apparatus which enables a performer to play simultaneously two or more guitars.

Still a further object of the invention is to provide improved guitar apparatus which maintains a pair of guitar necks, including the fingerboard and strings associated with each neck, in close proximity to one another such that a guitarist can quickly move a hand from the fingerboard on one guitar neck to the fingerboard on the other guitar neck.

Yet still another object of the invention is to provide improved apparatus for quickly releasably attaching one guitar to a second guitar.

These and other, further and more specific objects and advantages of the invention will be apparent to those skilled in the art from the following detailed description thereof, taken in conjunction with the drawings, in which.

Figure 1:
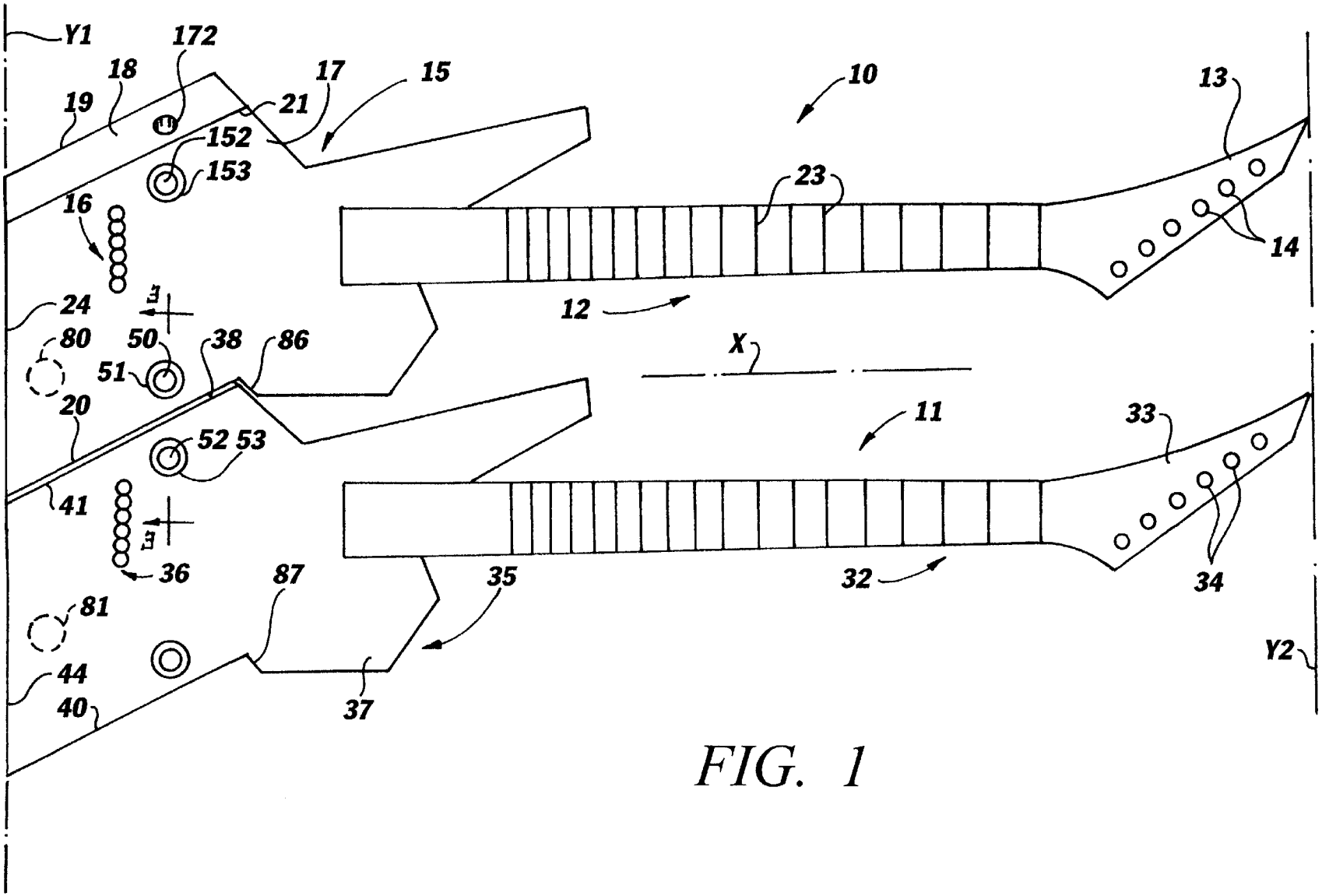
FIG. 1 is a top view illustrating a pair of guitars stacked in accordance with the principles of the invention.

Briefly, in accordance with the invention, I provide an improved apparatus for stacking a pair of guitars. Each of the guitars includes a body having a face and a back; a neck having a first end attached to the body and a distal end spaced away from the body; a peg head attached to the distal end of said neck; tuning keys on the peg head; and, a bridge mounted on the face of the body. The stacking apparatus includes a first contoured side on the body of one of the guitars, the side extending from the face to the back of the guitar; a conforming contoured side on the body of the other of the guitars, the conforming side extending from the face to the back of the other of guitars, and shaped and dimensioned such that the guitars can be stacked with the conforming side contacting and conforming to the first contoured side, and the face of one of the guitars generally parallel to and facing the same direction as the face of the other of the guitars; and, a mechanism for interconnecting one of the guitars with the other of the guitars when the guitars are stacked such that the conforming side contacts and conforms to the first contoured side, and the face of one of the guitars is generally parallel to and faces in the same direction as the face of the other of the guitars.

In another embodiment of the invention, I provide stacking apparatus for a pair of guitars. Each guitar includes a body having a face and a back; a neck having a first end attached to the body and a distal end spaced away from the body; a peg head attached to the distal end of the neck; tuning keys on the peg head; and, a bridge mounted on the face of the body. The stacking apparatus comprises stacking means for stacking the guitars. The stacking means includes a mechanism for interconnecting one of the guitars with the other of the guitars when the guitars are stacked such that the neck of one of the guitars is spaced apart from the neck of the other of the guitars such that the hand of a player can move between and move along each the necks while the player holds both of the pair of guitars.

In a further embodiment of my invention, I provide a guitar including a body having at least one face and one back; a pair of spaced apart necks each having a first end attached to the body and a distal end spaced away from the body, the necks being spaced apart from one another; a first peg head attached to the distal end of one of said necks; a second peg head attached to the distal end of the other of said necks; at least one bridge mounted on the front of the body; and, tuning keys on each of the peg heads.

Turning now to the drawings which depict the presently preferred embodiments of the invention for the purpose of illustrating the practice thereof, and not by way of limitation of the scope of the invention, and in which like reference characters refer to corresponding elements throughout the several views, FIGS. 1 to 5 illustrate guitar apparatus constructed in accordance with the invention and including guitars 10 and 11. For purposes of explanation, guitars 10 and 11 are identical in shape and construction. However, as would be appreciated by those of skill in the art, the shape and dimension of guitars 10 and 11 can be varied as desired. Guitars 10 and 11 can be acoustic or electric guitars, but normally each comprise an electric guitar.

Figure 2:
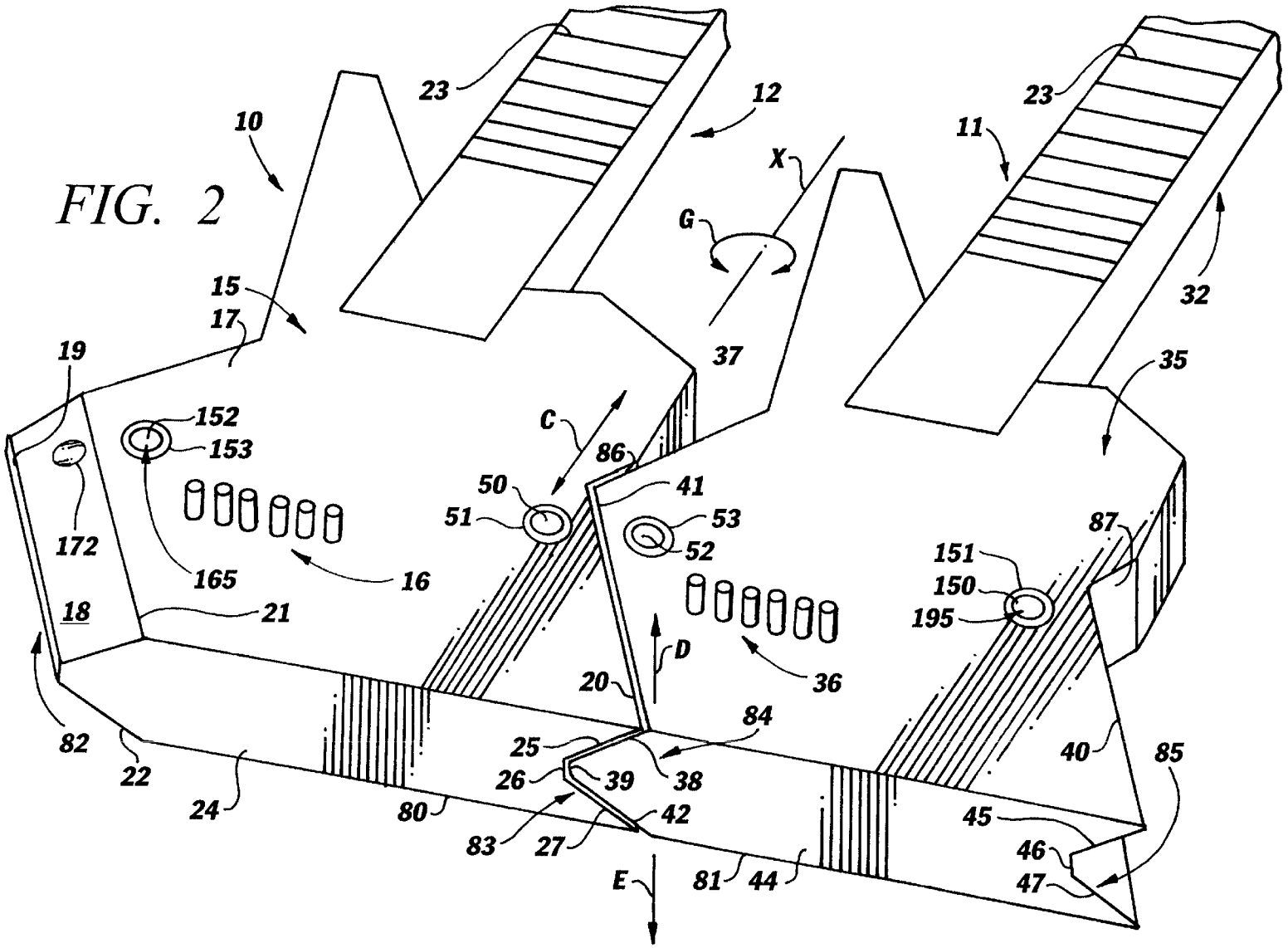
FIG. 2 is an end perspective view further illustrating the guitars of FIG. 1.

Guitar 10 includes body 15 and neck 12. One end of neck 12 is connected to body 15. The other distal end of neck 12 is connected to peg head 13. Tuning keys 14 are mounted in peg head 13. Body 15 includes face 17, end 24, and back 80 (FIG. 2). Bridge 16 is mounted on face 17. Strings (not shown for the sake of clarity) extend from bridge 16 to tuning keys 14 in conventional fashion. Volume, tuning and other controls 80 can be mounted on the guitar 10. One side of guitar 10 has a triangularly shaped tongue 82 which includes edge 21 and flat planar surfaces 18, 19, and 22. Another side of guitar 10 has a triangularly shaped groove 83 which includes edge 20 and flat planar surfaces 25, 26, and 27. The triangularly shaped groove 83 is shaped and dimensioned to receive and conform to a triangularly shaped tongue 84 from a second guitar.

Guitar 11 includes body 35 and neck 32. One end of neck 32 is connected to body 35. The other distal end of neck 32 is connected to peg head 33. Tuning keys 34 are mounted in peg head 33. Body 35 includes face 37, end 44, and back 81 (FIG. 2). Bridge 36 is mounted on face 37. Strings (not shown for the sake of clarity) extend from bridge 36 to tuning keys 34 in conventional fashion. Volume, tuning and other controls 81 can be mounted on the guitar 11. One side of guitar 11 comprises a triangularly shaped tongue 84 which includes edge 41 and flat planar surfaces 38, 39, and 42. Another side of guitar 11 comprises a triangularly shaped groove 85 which includes edge 40 and flat planar surfaces 45, 46, and 47. The triangularly shaped groove 85 is shaped and dimensioned to receive and conform to a triangularly shaped tongue from a second guitar. For example, groove 85 can receive tongue 82 in the same manner that groove 83 receives tongue 84.

When guitars 10 and 11 are abutted in the manner shown in FIGS. 1 and 2, planar surface 86 and groove 83 function to prevent movement of guitar 10 with respect to guitar 11 in the directions indicated by arrows C. Arrows C are parallel to axis X which is parallel to the longitudinal axes of necks 12 and 32.

On order to maintain guitars 10 and 11 in the position shown in FIGS. 1 and 2, the fastening mechanism illustrated in FIGS. 1 to 5 is utilized to fasten detachably the guitars together. Any other desired fastening mechanism for fixedly detachably holding guitars 10 and 11 in the position shown in FIGS. 1 to 5 can be utilized, including VELCRO (Trademark) fastening strips, straps extending around the bodies of each guitar 10 and 11, etc. The fastening mechanism can be utilized to secure together the bodies and/or necks of a pair of adjacent guitars at any point along the X axis (FIG. 1).

The fastening mechanism illustrated in FIGS. 1 to 5 includes buttons 65 and 95, springs 59 and 60, pin 61, and cylindrical openings 53, 90, 73, 92, 72, 96, 51, 91, and 93. Pin 61 includes detents 62 and 63. Button 65 includes cylindrical upper end 52, detent 55, and cylindrical lower end 57 with circular bottom surface 70. Button 95 includes cylindrical upper end 50, detent 54, and cylindrical lower end 56. The shape and dimension of button 65 is equivalent to the shape and dimension of button 95. The shape and dimension of spring 59 is equivalent to that of spring 60; of cylindrical opening 92 is identical to that of opening 93; of cylindrical opening 90 is identical to that of opening 91; of cylindrical opening 53 is identical to that of opening 51.

The flat circular ends 105, 106 of pin 61 can be spherically shaped 103, 104 and member 57 can be shaped such that when an end 103, 104 is pressed against member 57 when member 57 is in the position shown in FIG. 10, a force is generated which automatically displaces button 65 in the direction of arrow B without requiring that the user manually depress button 65 in the direction of arrow B. Once pin 61 reaches a position comparable to that shown in FIG. 3, then spring 59 displaces button 65 in a direction opposite that of arrow A so that button 65 returns to the position shown in FIG. 3 to lock pin 61 in position in opening 73. Buttons 65 and 95 and pin 61 can have any desired shape and dimension as long as they function to secure guitars 10 and 11 adjacent one another in the manner shown in FIGS. 1 and 2.

Figure 3:
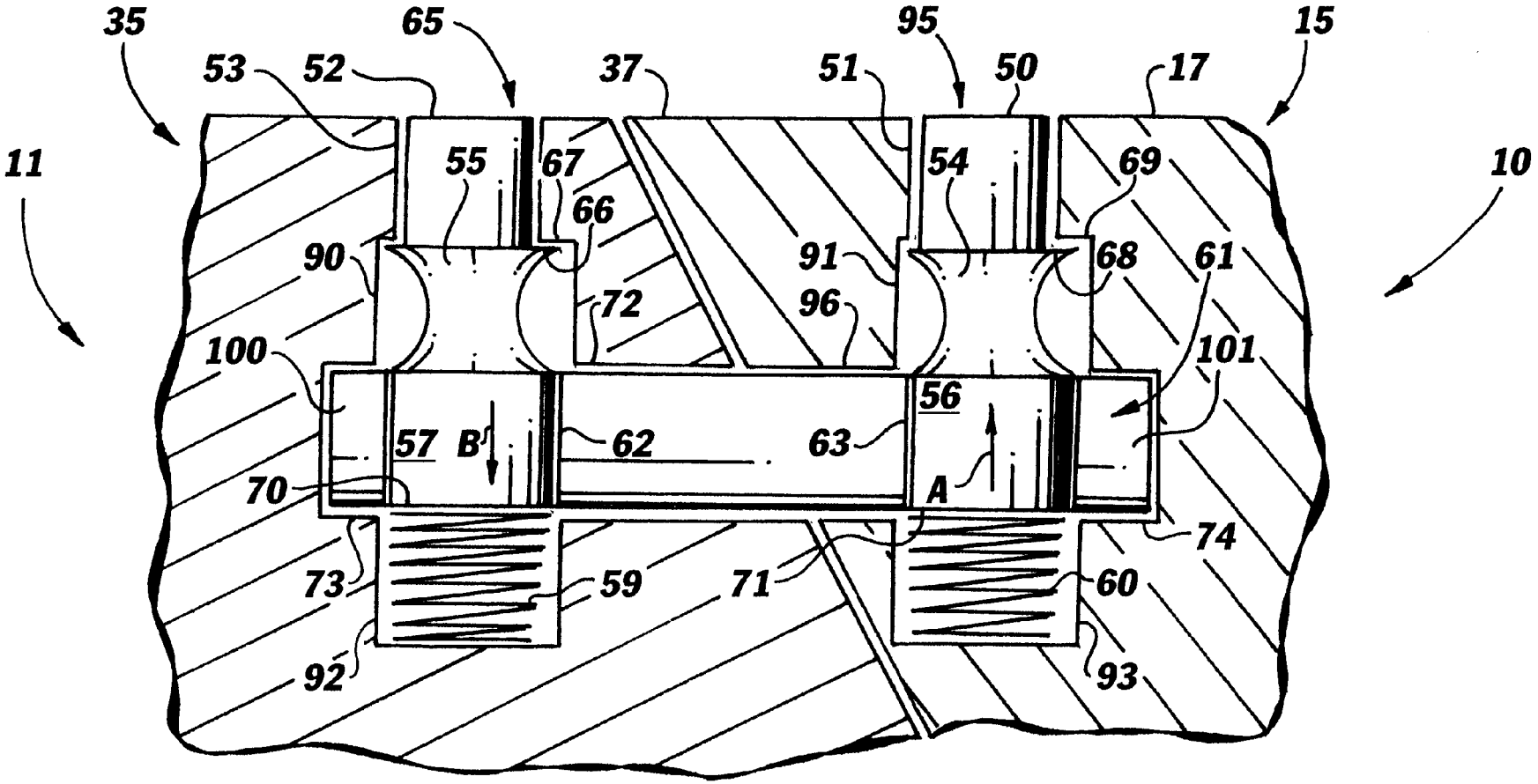
FIG. 3 is a side section view illustrating a releasable locking mechanism used to interconnect the guitars of FIG. 1 and taken along section line 3—3 thereof.
Figure 4:
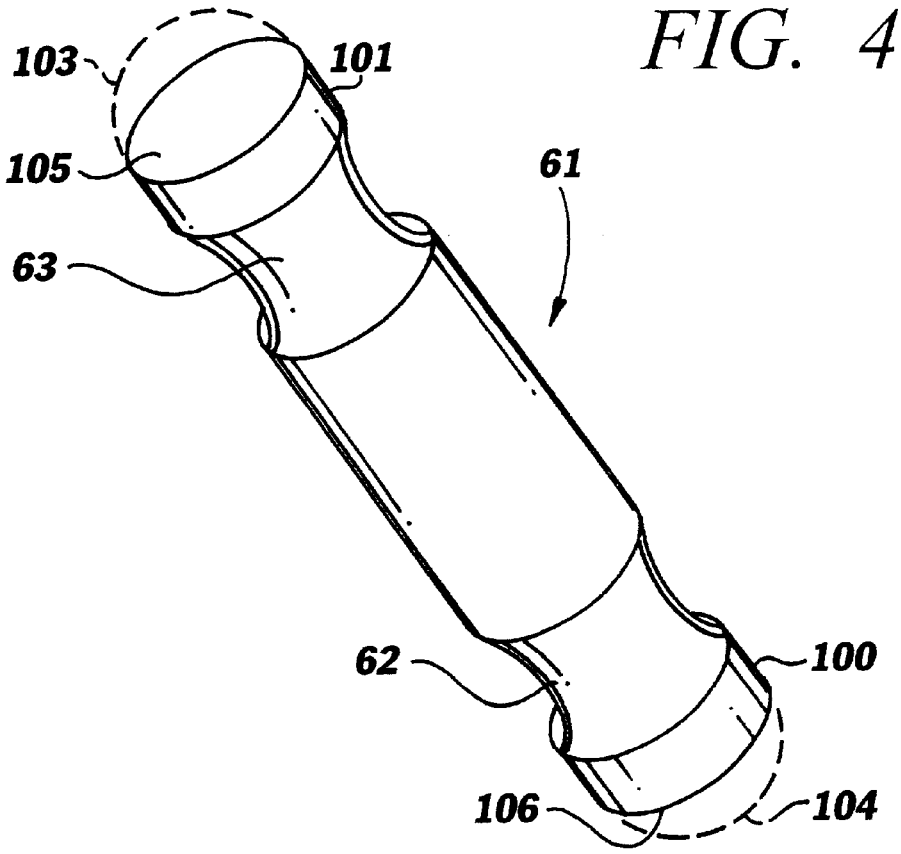
FIG. 4 is perspective view illustrating a locking pin or member used in the releasable locking mechanism of FIG. 3; and, FIG. 5 is a perspective view illustrating a release button used in the releasable locking mechanism of FIG. 3.
Figure 5:
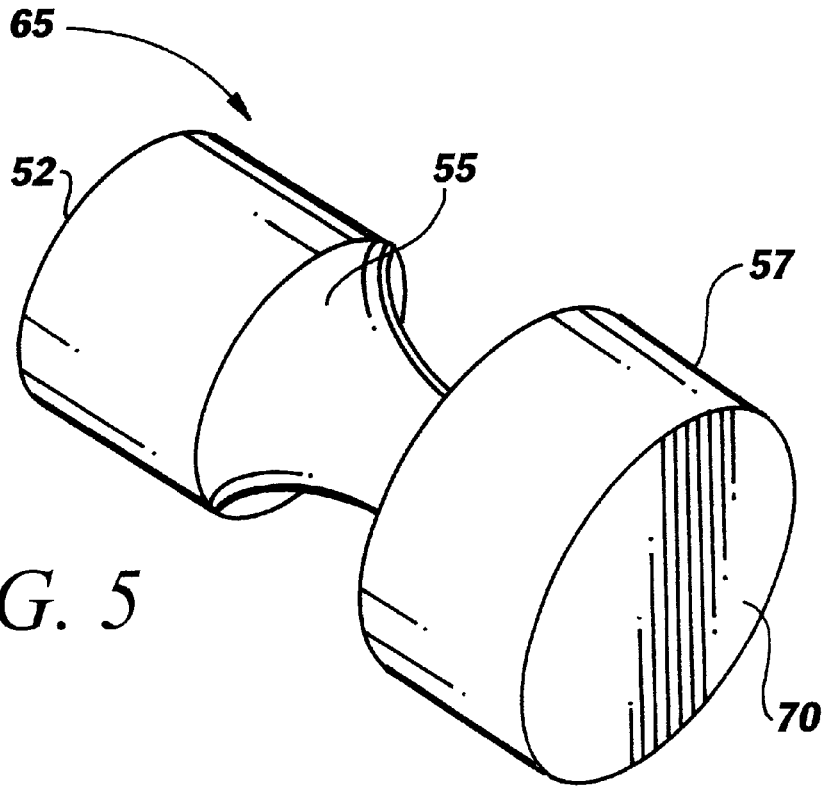

When button 95 is in the normal operative position illustrated in FIG. 3, spring 60 presses circular lip 68 against fixed circular surface 69. When button 65 is in the normal operative position illustrated in FIG. 3, spring 59 presses circular lip 66 against fixed circular surface 67.

In use of the fastening mechanism, pin 61 is inserted in guitar 11 before the guitar 10 is abutted adjacent guitar 11 in the manner shown in FIGS. 2 and 3. Pin 61 is inserted in guitar 11 by manually depressing button 65 in the direction of arrow B (FIG. 3) until spring 59 is compressed and cylindrical lower end 57 is seated in cylindrical opening 92 and detent 55 is positioned adjacent cylindrical opening 72. The end 100 of pin 61 is then slid into opening 72 to the position shown in FIG. 3. Detent 55 is shaped and dimensioned such that the end 100 of pin 61 can slide by detent 55 and into opening 73 to the position illustrated in FIG. 3. Once pin 61 is in the position shown in FIG. 3, button 65 is released and spring 59 causes button 65 to move in a direction opposite that of arrow B and to return to the position illustrated in FIG. 3. When button 65 is in the position shown in FIG. 3, a portion of member 57 extends into detent 62 and prevents pin 61 from being withdrawn from opening 72 out of the guitar 10. After end 100 is inserted in guitar 11 in the foregoing manner, then button 95 in guitar 10 is manually depressed to seat cylindrical lower end 56 in cylindrical opening 93 and to position detent 54 adjacent cylindrical opening 96. Guitar 10 is abutted against guitar 11 in the manner illustrated in FIGS. 1 and 2. When guitar 10 is moved into position against guitar 11, the cylindrical end 101 of pin 61 slides through cylindrical opening 96 into cylindrical opening 74 to the position shown in FIG. 3. Detent 54 is shaped and dimensioned such that the end 101 of pin 61 can slide by detent 54 and into opening 74 to the position illustrated in FIG. 3. Once end 101 is in the position shown in FIG. 3, button 95 is released and spring 60 causes button 95 to move in the direction of arrow A to the position illustrated in FIG. 3. When button 95 is in the position shown in FIG. 3, a portion of member 56 extends into detent 63 and prevents pin 61 from being withdrawn from opening 96 out of the guitar 10.

When groove 83 and tongue 84 are interfit as shown in FIG. 2 and pin 61 is installed in the manner shown in FIGS. 1 to 3, the movement of guitar 10 with respect to guitar 11 in the directions indicated by arrows C is prevented, rotation of guitar 10 with respect to guitar 11 about the X axis is prevented, and movement of guitar 11 up and down in the directions of arrows D and E while guitar 10 is stationary is prevented. The X axis is parallel to the longitudinal axes of necks 12 and 32 and is parallel to flat planar faces 17 and 37. Axes Y1 and Y2 are parallel to one another.

Buttons 165 and 195 have a shape and dimension equivalent to that of buttons 65 and 95. Button 165 includes upper cylindrical member 152. Button 195 includes upper cylindrical member 150. Member 152 is normally positioned in cylindrical opening 153. Member 150 is normally positioned in cylindrical openings 151. Cylindrical aperture 172 has a shape and dimension equivalent to that of aperture 72. The openings for button 165 are equivalent to the openings 53, 90, 92 for button 65. A spring equivalent to spring 59 is positioned beneath button 165 in the same manner that spring 59 is positioned beneath button 165. The openings for button 195 are equivalent to the openings 51, 91, 93 for button 95. A spring equivalent to spring 60 is positioned beneath button 195 in the same manner that spring 60 is positioned beneath button 95.

In order to separate guitars 10 and 11, button 65 (or 95) is fully depressed such that pin 61 can be slid out of aperture 72 and such that guitar 10 can be pulled away and separated from guitar 11.

Having described my invention in such terms as to enable those skilled in the art to understand and use it, I claim:

1. In combination with a pair of guitars each including a body having a face and a back, a neck having a first end attached to the body and a distal end spaced away from the body, a peg head attached to the distal end of the neck, tuning keys on the peg head, and a bridge mounted on the face of the body, the improvements comprising means for stacking said guitars, said stacking means including (a) a first contoured side on the body of one of the guitars, said side extending from the face to the back of said one of the guitars;

(b) a conforming contoured side on the body of the other of the guitars, said conforming side (i) extending from the face to the back of said other of the guitars, and (ii) shaped and dimensioned such that the guitars can be stacked with said conforming side contacting and conforming to said first contoured side, and the face of one of the guitars generally parallel to and facing the same direction as the face of the other of the guitars; and, (c) connecting means for interconnecting one of the guitars with the other of the guitars when the guitars are stacked such that (i) said conforming side contacts and conforms to said first contoured side, and (ii) the face of one of the guitars is generally parallel to and faces in the same direction as the other of the guitars;

said conforming contoured side being shaped and dimensioned to interlock with said first contoured side when said connecting means interconnects the guitars such that said conforming contoured side contacts said first contoured side;

said first contoured side and said conforming contoured side, when interlocked and contacting one another, preventing movement of one of he guitars with respect to the other along an axis parallel to the neck of at least one of the guitars; and, said first contoured side including faces forming a triangularly shaped groove which receives said conforming side, said conforming side including faces forming a triangularly shaped tongue.

2. In combination with a pair of guitars each including a body having a face and a back, a neck having a first end attached to the body and a distal end spaced away from the body, a peg head attached to the distal end of the neck, tuning keys on the peg head, and a bridge mounted on the face of the body, the improvements comprising means for stacking said guitars, said stacking means including (a) a first contoured side on the body of one of the guitars, said side extending from the face to the back of said one of the guitars;

(b) a conforming contoured side on the body of the other of the guitars, said conforming side (i) extending from the face to the back of to said other of the guitars, and (ii) shaped and dimensioned such that the guitars can be stacked with said conforming side conforming to said first contoured side, and the face of one of the guitars generally parallel to and facing the same direction as the face of the other of the guitars; and, (c) connecting means for interconnecting one of the guitars with the other of the guitars when the guitars are stacked such that (i) said conforming side conforms to said first contoured side, and (ii) the face of one of the guitars is generally parallel to and faces in the same direction as the face of the other of the guitars, said connecting means including fastener means for securing one of the guitars to the other of the guitars, said fastener means (iii) extending from said contoured side through said conforming side and into the body of the other of the guitars, and (iv) being releasably secured in the body of said other of the guitars.

3. The improvements of claim 2 wherein said fastener means extends through said contoured side into the body of said one of the guitars.

4. The improvements of claim 3 wherein said fastener means is releasably secured in the body of said one of the guitars.

5. The improvements of claim 3 wherein said fastener means is releasable when the guitars are stacked one on top of the other.

6. The improvements of claim 4 wherein said fastener means is releasable when the guitars are stacked one on top of the other.

7. The improvements of claim 2 wherein said fastener means is releasable when the guitars are stacked one on top of the other.

* * * * *